US005343959A

United States Patent [19]

Frisbee et al.

[11] Patent Number: 5,343,959

[45] Date of Patent: Sep. 6, 1994

[54] DOZER BLADE, FACE PLATE, AND EDGE PLATE ARRANGEMENT

[75] Inventors: Claude M. Frisbee, Schofield; Ronald H. Werner, Edgar, both of Wis.

[73] Assignee: Case Corporation, Racine, Wis.

[21] Appl. No.: 965,163

[22] Filed: Oct. 23, 1992

[51] Int. Cl.[5] ..... E02F 3/815

[52] U.S. Cl. ..... 172/701.3; 29/525.1; 29/891

[58] Field of Search ..... 172/701.2, 701.3, 701.1, 172/749, 747, 753, 772, 811, 815, 817; 111/156; 175/426, 435; 37/219, 266, 108 R

[56] References Cited

U.S. PATENT DOCUMENTS

| | | | |
|---|---|---|---|
| 1,543,222 | 6/1925 | McVeety | 172/701.3 |
| 1,586,229 | 5/1926 | Walters | 172/701.1 |
| 1,612,898 | 1/1927 | Abbe | 172/701.3 |
| 1,633,057 | 6/1927 | Wold | 172/701.3 |
| 1,744,139 | 1/1930 | Patton | 172/701.3 |
| 2,963,802 | 12/1960 | Gwinn, Jr. | 172/701.3 X |
| 3,243,907 | 4/1968 | Peursen | 172/701.3 |

FOREIGN PATENT DOCUMENTS

| | | | |
|---|---|---|---|
| 0142460 | 6/1980 | Fed. Rep. of Germany | 172/253 |

*Primary Examiner*—Clifford D. Crowder
*Assistant Examiner*—Ismael Izaguirre
*Attorney, Agent, or Firm*—Jansson & Shupe, Ltd.

[57] ABSTRACT

A dozer blade has (a) a face plate with an exterior surface, (b) an edge plate having a front surface, and (c) a replaceable cutting portion having a front surface and a thickness. The method includes the steps of forming the face plate to include a curved lower portion and attaching the edge plate to the lower portion. Attachment is at a position generally parallel to the projected exterior surface and spaced from the projected exterior surface by a dimension about equal to the thickness of the cutting portion. The method also includes the step of attaching the cutting portion to the edge plate so that the front surface of the cutting portion and the exterior surface of the face plate are generally coextensive. In that way, a "step" in the profile of the blade is avoided and material discharges more readily from the blade.

8 Claims, 4 Drawing Sheets

DOZER BLADE, FACE PLATE, AND EDGE PLATE ARRANGEMENT

FIELD OF THE INVENTION

This invention is related generally to earthmoving machinery and, more particularly, to such machinery having a dozer blade.

BACKGROUND OF THE INVENTION

A broad category of machines known as earthmoving machines are used in construction (and demolition) projects involving moving or removal of dirt and/or debris. As examples, self-loading scrapers, tractor dozers and the like are used in road construction and such dozers are used to dig basements for new buildings. And there are many other uses for such machines.

Briefly described, such machines move earth in much the same way that a wood plane shaves wood, i.e., by passing a blade across the earth surface and "rolling up" a layer of earth. Most such machines, which are hard-worked at least because they represent a very substantial investment, share a common feature. They have a blade with a main face plate (the curved plate forming most of the earth-pushing surface) and a relatively narrow, replaceable cutting edge mounted below the plate.

A replaceable cutting edge is desirable for many reasons. The entire blade is a relatively expensive repair component and the use of a replaceable edge greatly reduces the material cost of edge "renewal." It also reduces the labor cost since irrespective of the size of the blade (which can be several feet long and several feet high), a replacement cutting edge is much easier and quicker to handle than an entire replacement blade.

A type of known dozer blade with a replaceable cutting edge can, in certain earthmoving operations, be somewhat disadvantageous. One disadvantage relates to the fact that in the known blade, the lower edge of the face plate is "squared off" and presents an abutment-like surface on which dirt and other material "catches" as the layer of earth is removed.

Another disadvantage is that the front surface of the replaceable cutting edge is somewhat forward of the front surface of the main face plate. As a result, a "step" is formed between the main face plate and the upper part of the cutting edge.

Because of this step, dirt and other material does not discharge well from the blade. Rather, it "hangs up" on the step as the operator starts to raise the blade and move it away from the pile of dirt being pushed. To put it another way, the blade does not scour properly. And, of course, the more clay-like is the dirt being moved, the more likely it is that such dirt will catch in the step. This can be extremely annoying to the machine operator who expects that dirt moved to a pile will stay where placed as the machine moves away from the pile.

Another, less troublesome but nevertheless significant disadvantage is that to an experienced operator, the presence of the described step causes the machine and its blade to behave somewhat differently as dirt is being pushed. In other words, as the blade shaves or "planes" the earth surface, the machine exhibits a "feel" which is different (and less desirable) than that exhibited in the absence of such step.

This is a subjective perception not readily quantified—but there is little doubt about operator opinion in that regard. A paper titled "SHAPE OF DOZER BLADES TO ATTAIN SMALLEST FILLING RE- SISTANCE" (translated) discusses dozer blade configuration and performance and helps understand such perception.

A dozer blade with a replaceable cutting portion which overcomes the aforementioned disadvantages would be an important advance in the art.

OBJECTS OF THE INVENTION

It is an object of this invention to provide an improved dozer blade overcoming some of the problems and shortcomings of devices of the prior art.

Another object of this invention is to provide an improved dozer blade wherein the main face plate and the replaceable cutting portion are devoid of a dirt-catching "step."

Another object of this invention is to provide an improved dozer blade wherein the lower edge of the face plate presents a smooth-transition surface to dirt being moved.

Still another object of this invention is to provide an improved dozer blade which scours cleanly and from which material readily discharges.

Yet another object of this invention is to provide an improved method for making a dozer blade which meets the aforementioned objectives.

How these and other objects are accomplished will be apparent from the following description taken in conjunction with the drawing.

SUMMARY OF THE INVENTION

An aspect of the invention is an improvement in a method for making a dozer blade for moving material such as dirt and the like. The blade has (a) a face plate with an exterior surface, (b) an edge plate with a front surface, and (c) a replaceable cutting portion having a front surface and a thickness.

The improvement comprising the steps of forming the face plate to include an arcuate lower portion and attaching the edge plate to the lower portion at a position generally parallel to the projected exterior surface and spaced from the projected exterior surface by a dimension about equal to the thickness of the cutting portion.

Such method also includes the step of attaching the cutting portion to the edge plate so that the front surface of the cutting portion and the exterior surface of the face plate are generally coextensive. When the edge plate front surface and the exterior surface of the face plate are so arranged, a "step" in the blade profile is avoided and material discharges more readily from the blade.

The dozer blade includes a backing channel and the preferred method includes, in either order with respect to the edge plate attaching step, the step of attaching the arcuate portion and the backing channel to one another. The edge plate includes an upper edge and the attaching step includes abutting the upper edge against the arcuate lower portion and attaching the edge plate and the arcuate lower portion to one another.

Another aspect of the invention involves an improved dozer blade. In the improvement, the face plate includes an arcuate lower portion and the edge plate is attached to that curved lower portion. In a highly preferred arrangement, the edge plate includes an upper edge and the upper edge and the arcuate lower portion are attached to one another.

The cutting portion, the replaceable component of the dozer blade, is attached to the edge plate at a position, i.e., a location and angle, so that the front surface of the cutting portion and the exterior surface of the face plate are generally coextensive. And to help add rigidity to the blade structure, the blade includes a backing channel and the arcuate lower portion of the face plate and the backing channel are attached to one another.

Further aspects of the invention are set forth in the following detailed description and in the drawing.

DETAILED DESCRIPTIONS OF THE PREFERRED EMBODIMENTS

Figure 1:
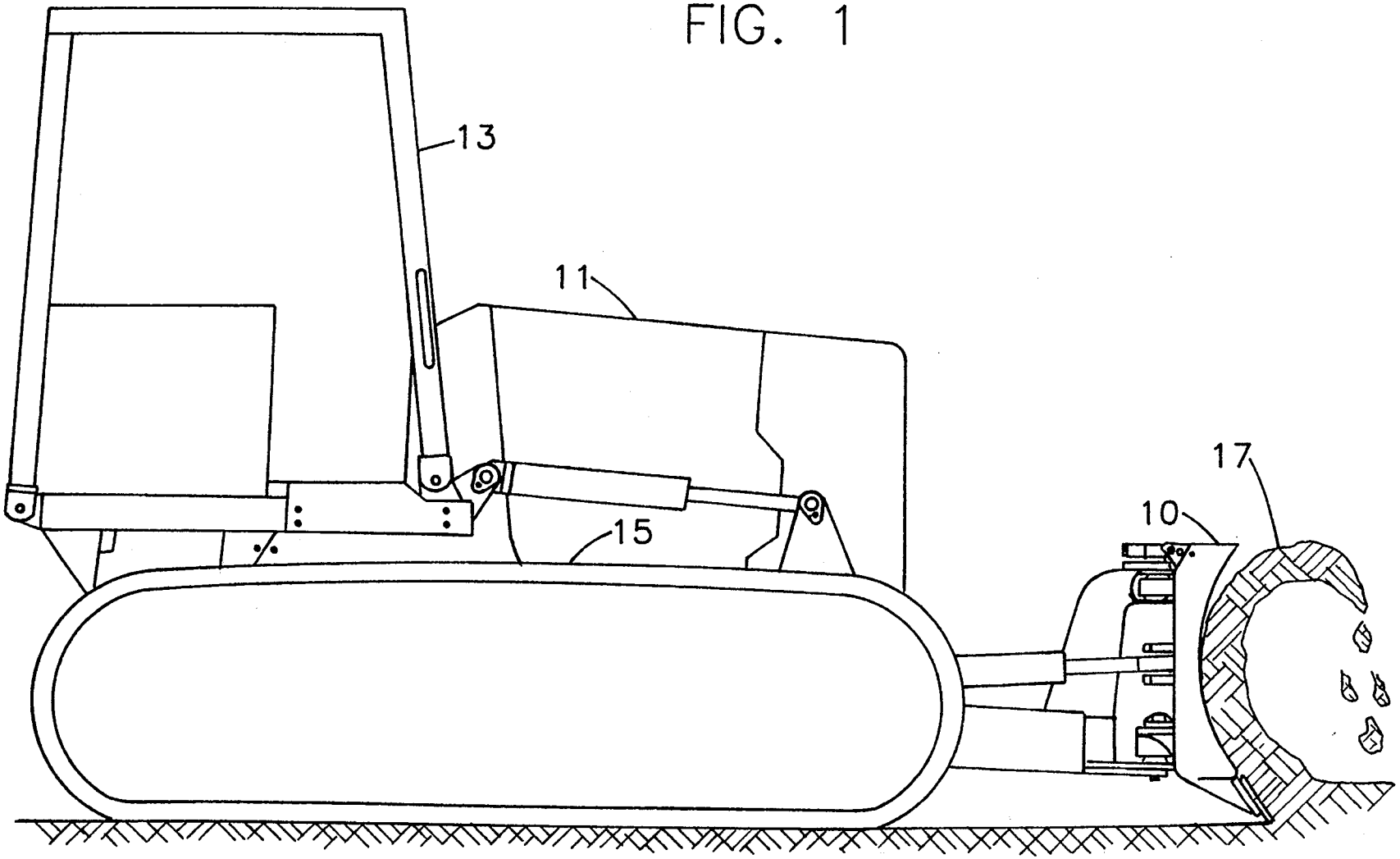
FIG. 1 is a representative side elevation view of a crawler tractor equipped with a dozer blade.

Referring to FIG. 1, the inventive method and dozer blade 10 are described in connection with an exemplary crawler tractor 11, often referred to as a "dozer" or "bulldozer." However, it should be appreciated that as used herein, the term "dozer blade" means a blade used on an earthmoving machine (e.g., road grader, scraper or dozer), and is not limited to blades used only on machines which are termed "dozers" in a strict sense.

The tractor 11 includes an operator's compartment 13, crawler tracks 15 for machine propulsion and a hydraulically-positioned, pivot-mounted dozer blade 10. Using controls in the compartment 13, the operator is able to raise or lower the blade 10 and to "skew" it left or right. With this latter capability, dirt or dirt-like material 17 is urged angularly to one side rather than merely forward as the tractor 15 moves forward. The operator can also tilt the blade 10 so that one end is higher than the other.

Figure 4:
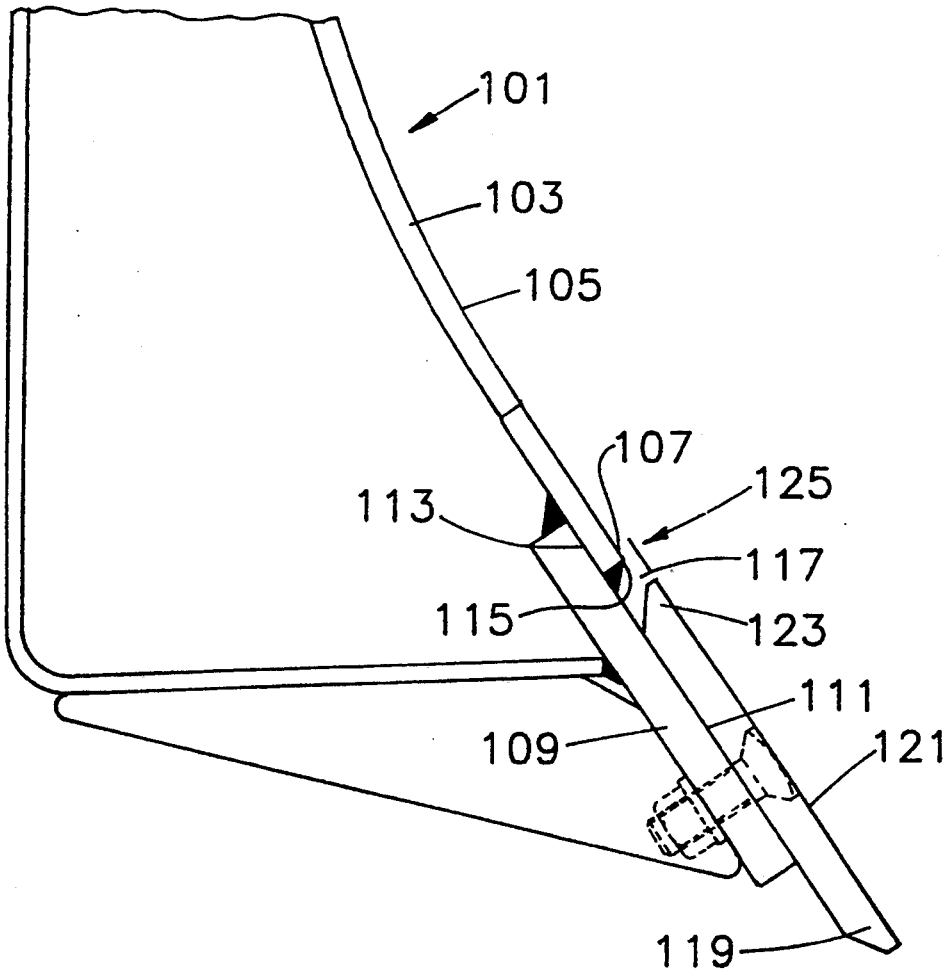
FIG. 4 PRIOR ART
FIG. 4 is a side elevation view of a prior art dozer blade with parts broken away and other parts in dashed outline.

Aspects of the invention will be better appreciated by first having an understanding of the arrangement of one type of known dozer blade 101. Referring to FIG. 4, such blade 101 has a face plate 103 with an exterior surface 105 which is that surface 105 in contact with material 17 being moved by the blade 101. The lower portion of the face plate terminates in an abutment-like, "squared-off" lower edge 107. The blade 101 also has an edge plate 109 with a front surface 111 and a portion of such surface 111 overlaps the rear surface 113 of the face plate 103 when those two pieces are joined together.

The squared-off lower edge 107 and rear-mounted edge plate 109 form a rather sharp edge 115 and an abrupt notch 117 in the surface of the blade 101. These features can somewhat impede the progress of material 17 sliding up the blade 101. And, of course, any impediment to smooth "filling" of the blade 101 is undesirable.

The blade 101 also has a replaceable cutting portion 119 with a front surface 121. Since such portion 119 is thicker than the face plate 103, its upper edge 123 juts out away from such face plate 103. This creates a "step" 125 which, like the edge 115 and notch 117 described above, has an undesirable effect on the ease with which material 17 moves upward along the portion 119 and face plate 103 as the blade 101 is advanced through dirt 17, for example.

More noticeable (and more undesirable) is the fact that this step 125 impedes the discharge of material 17 from the blade 101 as the blade 101 is lifted and moved away from such material 17. Putting it another way, material 17 "hangs up" on the step 125.

Figure 2:
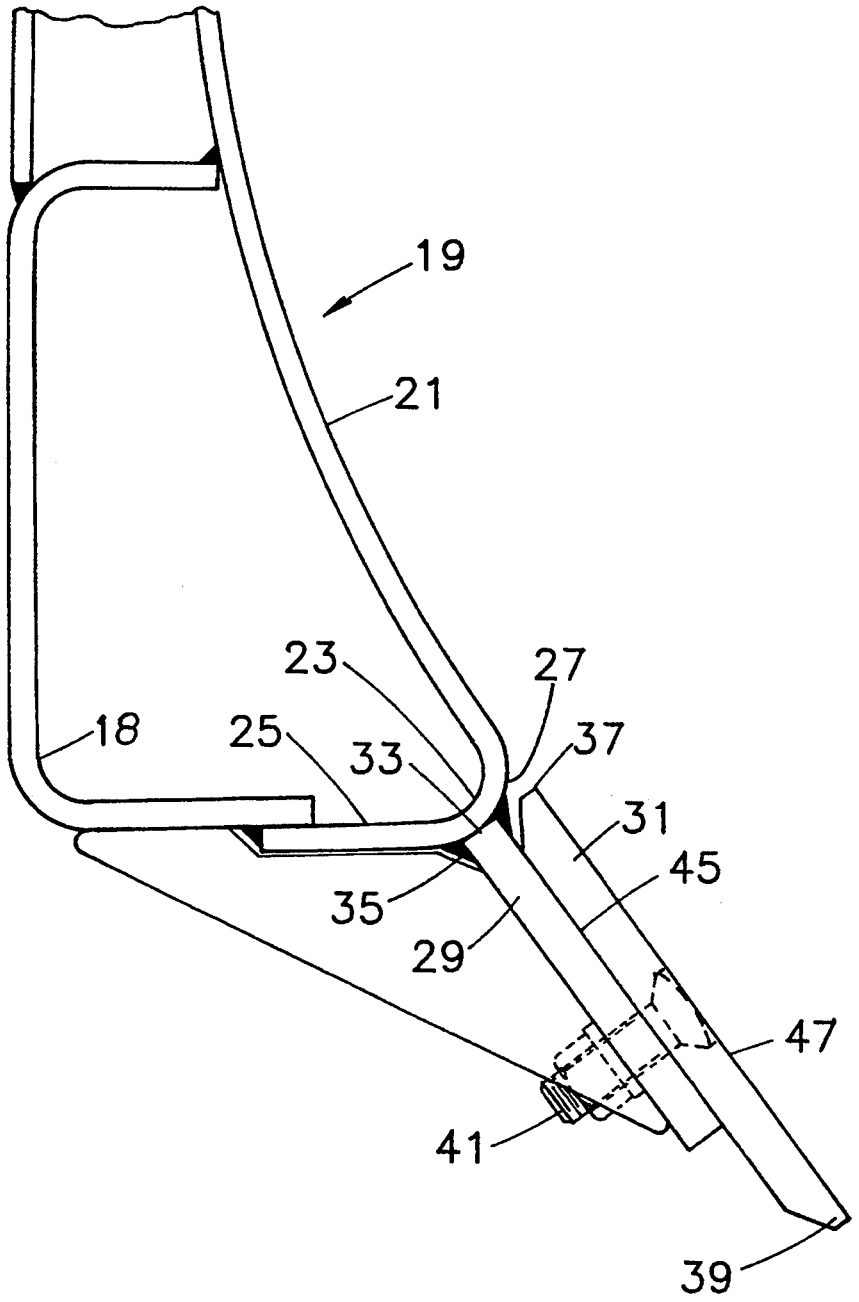
FIG. 2 is a side elevation of the improved dozer blade with parts broken away and other parts in dashed outline.

Referring now to FIG. 2, the improved dozer blade 10 has a face plate 19 with an exterior surface 21 and a curved or arcuate lower portion 23 attached to a backing channel 18. Such portion 23 extends rearward and terminates in a generally flat lip 25. As earth or other material 17 is engaged and moves upward along the blade 10, this lower portion 23 presents a region of smooth transition 27, quite unlike the sharp edge 115 discussed above.

The edge plate 29 (that component which supports the cutting portion 31) has an upper edge 33 which abuts the curved lower portion 23. The edge 33 and the portion 23 are rigidly attached to one another, preferably by welds 35.

The cutting portion 31 has an upper edge 37 and a lower edge 39, the latter being that part of the cutting portion 31 which bites into and shaves the surface of the earth or earth-like material 17. The cutting portion 31 (which is the primary wearing part of the blade 10) is readily replaceable in the field by removing its attachment bolts 41.

Figure 3:
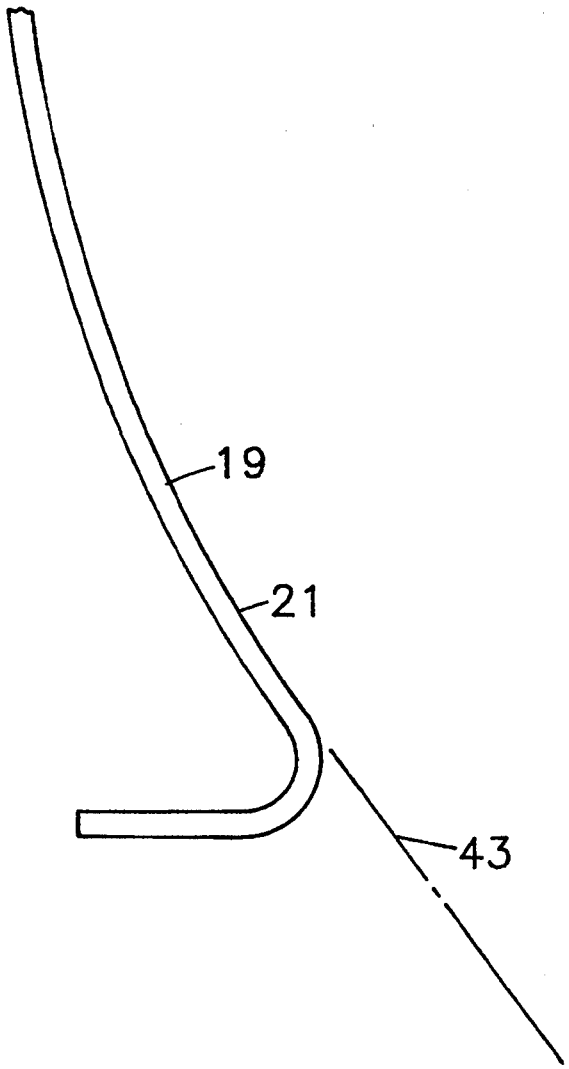
FIG. 3 is a side elevation view of a portion of the improved dozer blade showing a spatial "projection" of the front exterior surface of the blade face plate.

FIG. 3 depicts an example of a concept long used by engineering draftsmen in that it shows a "projection" of the exterior surface 21 of the face plate 19. The line of the projected surface 43 represents the such surface 21 and its position as it would be if the surface 21 were extended further downward and to the right as seen in FIG. 3. The significance of this projected surface 43 will become apparent from the following description.

When making the blade 10, the edge plate 29 is attached to the lower portion 23 at an angle such that the forward surface 45 of the plate 29 is generally parallel to the projected surface 43. And attachment of the plate 29 to the portion 23 is at a position such that the forward surface 45 of the plate 29 and the projected surface 43 are spaced from one another by a dimension about equal to the thickness of the cutting portion 31. Stated in different terms, the front surface 47 of the cutting portion 31 and the exterior surface 21 of the face plate 19 are generally coextensive. Construction of the blade 10 in this way eliminates the step 125 resulting from the aforementioned jutting upper edge 123 of the cutting portion 119 and material 17 discharges more readily from the blade 17.

The cutting portion 31 is preferably made of heat treated boron steel. However, such portion 31 may also be made of carbon steel which is not heat treated. A portion 31 made from such carbon steel is likely to be less expensive than one of boron steel—but it will preferably be thicker. And other types of portions 31 may have yet other, different thicknesses or even different cross-sectional shapes. Notwithstanding, the new method permits attachment of the edge plate 29 to the curved lower portion 23 at a position and angle such that the front surface 47 is in "registry" with the projected surface 43 and therefore co-extensive with the exterior surface 21 of the faceplate 19.

While the principles of this invention have been described in connection with specific embodiments, it should be understood clearly that these descriptions are made only by way of example and are not intended to limit the scope of the invention.

We claim:

1. In a method for making a dozer blade for moving material and comprising (a) a face plate with an exterior surface, (b) an edge plate having a front surface, and (c) a replaceable cutting portion having a front surface and a thickness, the improvement comprising the steps of:

forming the face plate to include (a) an arcuate lower portion, (b) a lip extending rearward from the arcuate lower portion and terminating in a lip rear edge, and (c) knee-like transition region between the arcuate lower portion and the lip;

attaching the edge plate to the transition region at a position generally parallel to a projection of the exterior surface, the edge plate being spaced from the projection by a dimension about equal to the thickness of the cutting portion; and attaching the cutting portion to the edge plate.

2. The method of claim 1 wherein the dozer blade includes a backing channel and the method includes, in either order with respect to the edge plate attaching step, the step of attaching the face plate arcuate lower portion and the backing channel to one another.

3. The method of claim 1 wherein the edge plate includes an upper edge and the attaching step includes abutting the upper edge and the transition region against one another.

4. In a method for making a dozer blade for moving material and comprising (a) a face plate with an exterior surface, (b) an edge plate having a front surface, and (c) a replaceable cutting portion having a front surface and a thickness, the improvement comprising the steps of:

forming the face plate to include an arcuate lower portion;

attaching the edge plate to the arcuate lower portion of the face plate at a position generally parallel to a projection of the exterior surface and spaced from the projection by a dimension about equal to the thickness of the cutting portion;

attaching the cutting portion to the edge plate so that the front surface of the cutting portion and the exterior surface of the face plate are generally coextensive; the method also including the step of providing a backing channel and further includes, in either order with respect to the edge plate attaching step, the step of:

attaching the face plate arcuate lower portion and the backing channel to one another.

5. In a dozer blade for moving material and comprising (a) a face plate with an exterior surface, (b) an edge plate having a front surface, and (c) a replaceable cutting portion having a front surface and a thickness, the improvement wherein:

the face plate includes an arcuate lower portion;

the edge plate is attached to the arcuate lower portion of the face plate;

the blade includes a backing channel attached to the face plate arcuate lower portion; and the cutting portion is attached to the edge plate so that the front surface of the cutting portion and the exterior surface of the face plate are generally coextensive, whereby material discharges more readily from the blade.

6. In a dozer blade for moving material and comprising (a) a face plate with an exterior surface, (b) an edge plate having a front surface and an upper edge, and (c) a replaceable cutting portion having a front surface and a thickness, the improvement wherein:

the face plate includes (a) an arcuate lower portion, (b) a lip extending generally horizontally rearward from the arcuate lower portion, and (c) a knee-like transition region between the arcuate lower portion and the lip;

the upper edge of the edge plate is attached to the transition region; and, the cutting portion is attached to the edge plate so that the front surface of the cutting portion and the exterior surface of the face plate are generally coextensive.

7. The dozer blade of claim 6 wherein the blade includes a backing channel and the face plate arcuate lower portion and the backing channel are attached to one another.

8. The dozer blade of claim 6 wherein the edge plate includes an upper edge and the upper edge and the face plate arcuate lower portion are attached to one another.

* * * * *